United States Patent [19]

Judkins

[11] 4,445,303

[45] May 1, 1984

[54] WEDGE-TYPE CONCRETE INSERT

[76] Inventor: Milton W. Judkins, 4606 Birch, Bellaire, Tex. 77401

[21] Appl. No.: 371,562

[22] Filed: Apr. 26, 1982

[51] Int. Cl.[3] ..... E04C 1/00

[52] U.S. Cl. ..... 52/98; 52/699; 52/704

[58] Field of Search ..... 52/699, 700, 701, 703, 52/704, 98, 100

[56] References Cited

U.S. PATENT DOCUMENTS

| | | | |
|---|---|---|---|
| 1,088,290 | 2/1914 | McAllister et al. | 52/699 |
| 1,621,877 | 3/1927 | Fitz Gerald | 52/704 |
| 1,670,443 | 5/1928 | Fishel et al. | 52/699 |
| 2,135,118 | 11/1938 | Stewart | 52/704 |
| 2,176,450 | 10/1939 | Barnett | 52/704 |
| 3,005,292 | 10/1961 | Reiland | 52/704 |
| 3,157,966 | 11/1964 | Sherburne | 52/701 |
| 3,479,785 | 11/1969 | Asch | 52/704 |

*Primary Examiner*—Henry E. Raduazo

*Attorney, Agent, or Firm*—Arnold, White & Durkee

[57] ABSTRACT

A concrete insert suitable to provide an anchor in a concrete slab is disclosed. This insert provides an especially suitable anchor for hanging objects from a poured concrete floor in multi-story construction. The concrete insert comprises a plurality of anchoring surfaces suitable for engaging the concrete slab, a coupling means suitable for coupling an object to the insert anchor and means for increasing the engaging force exerted by the anchoring surfaces when an increased force is applied by the anchored object through the coupling means. The concrete insert anchor most preferably employs a curved distorting surface adjacent and convex to one end of the anchoring surfaces. Force applied to this distorting surface through the coupling means exerts an outward force at its ends, thus forcing the adjacent ends of the anchoring surfaces into stronger engagement with the surrounding concrete and increasing the engaging force exerted thereon.

2 Claims, 2 Drawing Figures

WEDGE-TYPE CONCRETE INSERT

BACKGROUND OF THE INVENTION

1. Field of the Invention

This invention relates generally to a concrete insert device for use in anchoring objects to or hanging objects from a poured concrete slab, especially a concrete floor. More particularly, an insert, both simple to manufacture and easy to use, being a generally wedge-shaped and including a distorting surface to increase the engaging force power as additional force is applied to the anchor is disclosed.

2. Description of the Background

Concrete inserts and anchors are used extensively in both commercial and residential construction. Insert anchors provide means for anchoring objects to concrete slabs. These inserts are particularly useful for anchoring objects above or hanging objects below concrete slab floors. In use, these inserts are installed on the form prior to the concrete pour. Such inserts provide a coupling, generally a threaded anchor bolt, for attachment of objects to the finished concrete slab. For example, such inserts embedded in the lower side of a poured concrete floor in a multi-story building provide anchor points for the hanging of pipes and other similar objects or direct attachment points for the attachment of conduit, pipe clips or the like.

Commonly, these concrete inserts have been provided by static bolts embedded in the concrete or by inserts for engaging such bolts. These bolts or inserts are positioned on the form prior to the concrete pour. A conical support of plastic or other such material is often used to maintain the bolt in an upright position during pouring of the concrete slab. These inserts, although relatively easy to use, produce a static insert having no ability to force the anchoring surfaces outward to increase the engaging force as the anchored object exerts increased force on the coupling means. Other inserts have included threaded inserts which must be bolted through a hole in the form prior to the concrete pour. These inserts are time-consuming to install, the bolts must be removed prior to form removal and the forms are prematurely ruined by the holes drilled therein. Other static inserts have provided supports into which bolts may be inserted, being held therein by their enlarged heads.

The above described inserts all provide static anchors having no capability to increase the engaging force by forcing the anchoring surfaces outward as increased force is exerted on the anchor by the object suspended or anchored. Further, the described inserts may provide weaker anchors since the engaging area is generally so small. At least one of the above inserts suffers from an inconvenient and time-consuming means of installation. These and other disadvantages associated with such inserts are clear. The art has long sought a simple, easily manufactured, easily used, yet reliable and strong concrete insert anchor.

SUMMARY OF THE INVENTION

The concrete insert anchor of the present invention overcomes the foregoing disadvantages and provides an easily manufactured, easily used, yet strong and reliable concrete insert suitable to provide an anchor in a concrete slab.

The concrete insert of the present invention comprises in its simplest embodiment a plurality of anchoring surfaces suitable for engaging a concrete slab. This insert further comprises a coupling means suitable for coupling an object to the insert and a means for increasing the engaging force exerted by the anchoring surfaces when an increased force is applied to the coupling means by the anchored object. Optionally the present invention may include breakaway positioning tab means suitable to position the insert on a form during installation, yet easily removable with the form to provide an aesthetically pleasing concrete surface, free of extraneous materials associated with the insert.

Another feature of the concrete insert anchor of the present invention is the use of a distoring surface capable of distorting under increased force applied through the coupling means to increase the engaging force exerted by the anchoring surfaces. At least a portion of the engaging force is directed lateral to the direction of engagement of the object by forcing apart the ends of the anchoring surfaces adjacent to the distorting surface. In another feature of the present invention the ends of the anchoring surfaces adjacent to the distorting surface are separated by a greater distance than at least some other portion of the anchoring surfaces, preferably the ends away from the distorting surface. These features combined to produce an anchor exerting an additional engaging force on the surrounding concrete when a greater force is applied to the coupling means.

The concrete insert anchor of the present invention has many advantages. It provides a strong and reliable anchor whose lateral engaging force increases as the force applied through the coupling means increases. Therefore, heavier objects may be hung from such an anchor without fear of failure. Further, the concrete insert anchors of the present invention are easily installed by one worker without requiring the boring of holes in the plywood forms. The forms and breakaway positioning tabs are easily removable to yield a finished job. These and other meritorious features and advantages of the present invention will be more fully appreciated from the following detailed description and claims.

Figure 1:
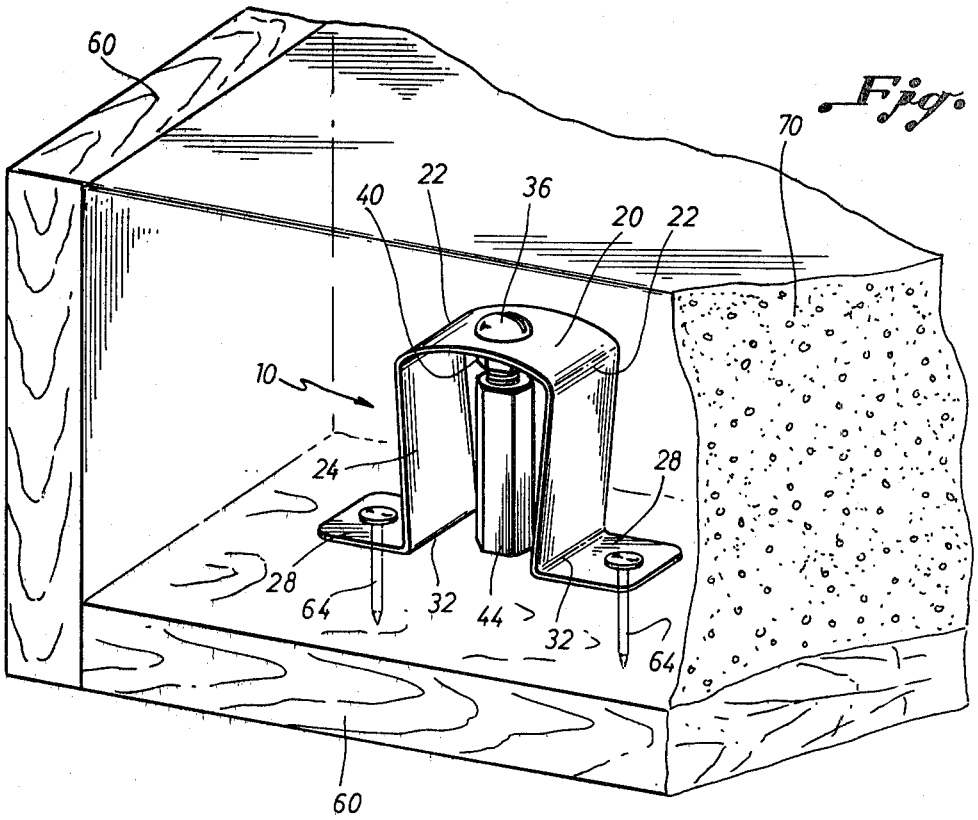
FIG. 1 is a perspective drawing of the preferred embodiment of the concrete insert anchor in its intended environment of use, illustrating the anchor positioned within a poured concrete slab and attached to the wooden form with breakaway positioning tabs.

While the invention will be described in connection with the preferred embodiment, it will be understood that it is not intended to limit the invention to that embodiment. On the contrary, it is intended to cover all alternatives, modifications and equivalents as may be included within the spirit of the invention as defined in the appended claims.

DETAILED DESCRIPTION OF THE PREFERRED EMBODIMENT

The concrete insert 10 of the present invention is suitable for use in providing an anchor in a concrete slab, particularly in providing a hanging support anchor for hanging pipe or the like below a concrete slab floor in multi-story construction. In the preferred embodiment, illustrated in the figures, concrete insert 10 includes a deformable anchoring surface 20 to provide a means of increasing the engaging force exerted by anchoring surfaces 24 by tending to force the adjacent portions of anchoring surfaces 24 further apart and into closer contact with the surrounding concrete 70.

Concrete insert 10 comprises in its simplest embodiment a plurality of anchoring surfaces 24 suitable for engaging the surrounding concrete slab 70. Concrete slab 70 is poured and forms around insert 10 which is positioned on form 60. Insert 10 is further characterized by a coupling means suitable for coupling an object, such as hook 48 to the insert. Means for increasing the engaging force exerted by anchoring surfaces 24 on concrete 70 when an increased force is applied to the coupling means by the anchored object is provided.

In a more preferred embodiment a distorting surface 20 provides the means for increasing the engaging force exerted by anchoring surfaces 24. In this embodiment a plurality, preferably two, of anchoring surfaces 24 are located on opposite sides of the coupling means. Anchoring surfaces 24 are characterized by having their ends adjacent to distorting surface 20 being located at a greater distance from the center line of the coupling means than at least another portion of anchoring surfaces 24, preferably the ends of anchoring surfaces 24 away from distorting surface 20. Where more than one anchoring surface 24 is used, their ends nearest distorting surface 20 are farther apart than at least another portion thereof, preferably their ends away from distorting surface 20. In a more preferred embodiment two anchoring surfaces 24 and one distorting surface 20 are produced from a single piece of flexible rigid material, such as 10–16 gauge sheeted steel bent at 22 to form generally quadrant-shaped insert 10.

Figure 2:
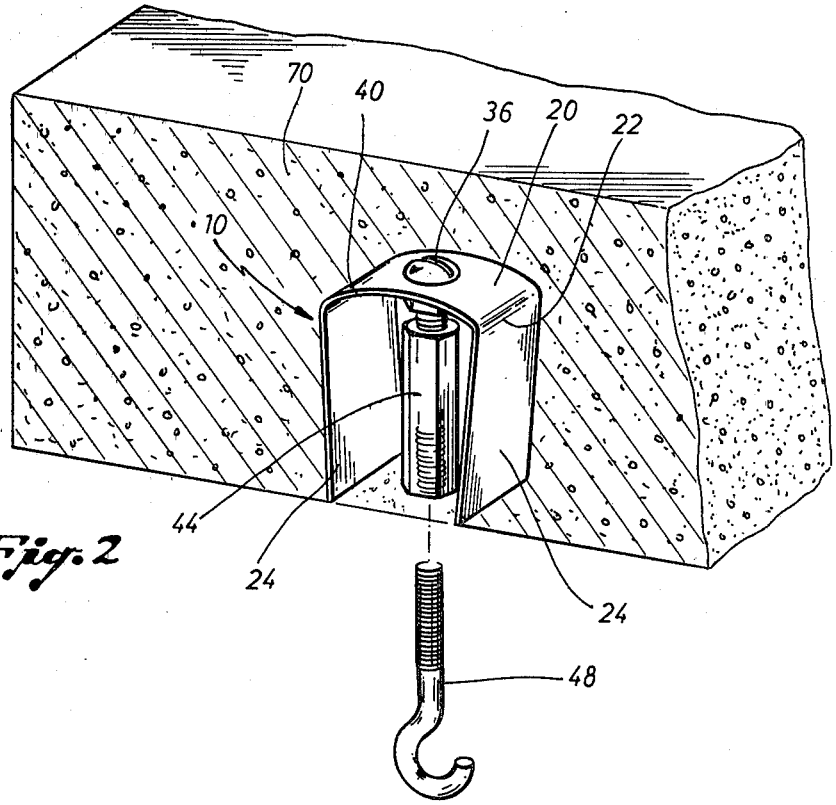
FIG. 2 is a perspective drawing of the preferred embodiment of the concrete insert anchor in a poured concrete slab after removal of the wooden forms.

A further optional feature of the present invention is breakaway positioning tab means 28 adjacent the ends of anchoring surfaces 24 away from distorting surface 20. Breakaway tabs 28 are suitable to position insert 10 on form 60 during installation prior to concrete pour, yet are easily removable with form 60. Breakaway tabs 28 may easily and conveniently be formed by bending and scoring insert 10 at 32 as shown in FIG. 1. Tabs 28 would include holes (not shown) through which nails 64 or other fastening means could be driven to securely affix insert 10 in place on form 60. After concrete 70 has been poured and is set, tabs 28 break away from insert 10 during removal of form 60 to produce an insert anchor having little visible impact on the external concrete surface as shown in FIG. 2.

The concrete insert 10 of the present invention further includes a coupling means suitable for coupling an object, such as hook 48, to insert 10. In a preferred embodiment this coupling means is engaged through distorting surface 20 between anchoring surfaces 24. A convenient coupling means is provided by the combination of bolt 36 passing through a bore (not shown) in distorting surface 20. A small nut 40 may optionally be employed with bolt 36. Coupling of the objects to be hung or anchored is achieved in one embodiment using elongated threaded coupling nut 44, internally threaded to cooperate with bolt 36 at one end and constructed to cooperate with the object to be hung or anchored at the other end. This cooperation may easily be provided by internal threading at the opposite end of elongated coupling nut 44 to cooperate with an externally threaded hook 48 or similar device.

In a preferred embodiment of the present invention means for increasing the engaging force is provided by cooperation of a curved distorting surface 20 and a plurality of anchoring surfaces 24. Force applied to distorting surface 20 by the object to be hung or anchored through the coupling means produces a force at lines 22 tending to force outward or spread apart the adjacent edges of anchoring surfaces 24 and increasing their engaging force on surrounding concrete 70. In the most preferred embodiment distorting surface 20 is convex to the direction of force applied by the hung or anchored object and convex to the anchoring surfaces.

The foregoing description of the invention has been directed in primary part to a particular preferred embodiment in accordance with the requirements of the patent statutes and for purposes of explanation and illustration. It will be apparent, however, to those skilled in the art that many modifications and changes in this specific apparatus may be made without departing from the scope and spirit of the invention. For example, any conventional coupling means may be used to engage the object to be hung or anchored with the concrete insert anchor of the present invention. Therefore, the invention is not restricted to the particular form of construction illustrated and described, but covers all modifications which may fall within the scope of the following claims.

It is applicant's intention in the following claims to cover such modifications and variations as fall within the true spirit and scope of the invention.

What is claimed is:

1. A concrete anchor suitable for a concrete slab, comprising:

a first pair of generally aligned anchoring surfaces which include first and second ends, said anchoring surfaces being arranged to diverge such that said first ends are separated by a greater distance than said second ends;

a pair of generally flat, spaced, generally coplanar tabs suitable for positioning the anchor on a form or the like during installation, each tab being interconnected with a respective second end of said anchoring surfaces such that said tabs can be broken away from said anchoring surfaces;

an opening in each tab to receive a means for securing the anchor to a form or the like;

an additional anchoring surface interconnecting said first ends of said first pair of anchoring surfaces; and means interconnected with said additional anchoring surface for coupling an object to said anchor such that the weight of said object is transmitted from said coupling means to said additional anchoring surfaces and then to said diverging first pair of anchoring surfaces.

2. The anchor as defined in claim 1, wherein said additional anchoring surface is convex with respect to said first pair of anchoring surfaces and is capable of distorting under pressure to tend to force said first ends of said first pair of anchoring surfaces apart.

* * * * *